US005385198A

United States Patent [19]

Ota et al.

[11] Patent Number: 5,385,198

[45] Date of Patent: Jan. 31, 1995

[54] VACUUM CASTING APPARATUS

[75] Inventors: Atsushi Ota, Toyota; Minoru Uozumi, Aichi; Hirokazu Onishi, Toyota, all of Japan

[73] Assignee: Toyota Jidosha Kabushiki Kaisha, Toyota

[21] Appl. No.: 104,043

[22] PCT Filed: Dec. 16, 1992

[86] PCT No.: PCT/JP92/01644

§ 371 Date: Aug. 18, 1993

§ 102(e) Date: Aug. 18, 1993

[87] PCT Pub. No.: WO93/11895

PCT Pub. Date: Jun. 24, 1993

[30] Foreign Application Priority Data

Dec. 19, 1991 [JP] Japan ..... 3-354845

[51] Int. Cl.[6] ..... B22D 18/06

[52] U.S. Cl. ..... 164/254; 164/133; 164/306

[58] Field of Search ..... 164/63, 254, 119, 133, 164/306

[56] References Cited

U.S. PATENT DOCUMENTS

| | | | |
|---|---|---|---|
| 2,847,739 | 8/1958 | Sylvester | 164/119 |
| 5,109,914 | 5/1992 | Kidd et al. | 164/133 |

FOREIGN PATENT DOCUMENTS

| | | | |
|---|---|---|---|
| 56-121069 | 8/1981 | Japan . | |
| 61-182868 | 8/1986 | Japan . | |
| 63-72463 | 4/1988 | Japan | 164/254 |
| 2-155557 | 6/1990 | Japan . | |
| 3-31058 | 3/1991 | Japan . | |
| 3-68955 | 7/1991 | Japan . | |
| 3-198969 | 8/1991 | Japan . | |
| 4158968 | 6/1992 | Japan | 164/254 |
| 4178254 | 6/1992 | Japan | 164/254 |
| 4270056 | 9/1992 | Japan | 164/119 |
| 0377987 | 7/1964 | Switzerland | 164/63 |

*Primary Examiner*—Kurt Rowan
*Assistant Examiner*—James Miner
*Attorney, Agent, or Firm*—Finnegan, Henderson, Farabow, Garrett & Dunner

[57] ABSTRACT

A vacuum casting apparatus of the type wherein a gate mechanism (12 and 10) is closed to form a seal. The interior of a cavity (6) is evacuated by a vacuum pump. The side of the gate mechanism (12 and 10) opposite to the cavity is filled with molten metal. The gate mechanism includes a ring-shaped groove (10*e*) having a V-shaped cross section positioned on the side opposite to the cavity which extends towards the sealing portion of the gate mechanism (12 and 10). With this arrangement, the molten metal in passage (8) fills the ring-shaped groove (10*e*) and enters the small clearance which exists in the sealing portion of the gate mechanism. The molten metal solidifies both within the ring-shaped groove (10) and this small clearance formed in the sealing portion. The resulting solidified metal piece has generally a ring shape that can be readily peeled off from the gate mechanism (12 and 10) following die release.

4 Claims, 5 Drawing Sheets

VACUUM CASTING APPARATUS

TECHNICAL FIELD

This invention relates to an apparatus for carrying out a vacuum casting method wherein a cavity is evacuated, and molten metal is temporarily stored in a molten metal passage; and, then, the molten metal is sucked into the cavity for casting purposes by opening a gate previously blocking communication between the cavity and the molten metal passage.

BACKGROUND ART

In carrying out the above vacuum casting method, it is desirable to enhance the degree of vacuum in the cavity. With a higher degree of vacuum, it is possible to prevent generation of blowholes in the molten metal, and this permits obtaining high quality casting. In order to enhance the degree of vacuum in the cavity, it is required to enhance the sealing capacity of the gate for blocking the communication between the cavity and the molten metal passage. A casting apparatus to this end has been proposed in Japanese Laid-Open Utility Model Publication No. 3-31058. This will now be described with reference to FIG. 5.

As shown in FIG. 5, this apparatus comprises a cavity 202 formed in a casting die 201. The cavity 202 can communicate with a molten metal passage 210 via a sprue 202*a*. The molten metal passage 210 is immersed in molten metal 206 heated and melted in a melting furnace 208. A gate piston 212 is provided for switching on and off the communication between the cavity 202 and the molten metal passage 210. The gate piston 212 is lowered to bring its lower end surface 212*c* into abutting engagement with an abutment surface 215 formed on the casting die, thereby blocking the communication between the cavity 202 and the molten metal passage 210. A vacuum pump 204 is connected to the cavity 202. A pressure reducing pump 220 is connected to the molten metal passage 210 via a passage 212*b*. Designated at 212*a* is an exhaust vent.

This apparatus is operated as follows. First, the gate piston 212 is lowered to bring the lower end surface 212*c* into abutting engagement with an abutment surface 215. Thus, the communication between the cavity 202 and the molten metal passage 210 is blocked. In this state, the pressure in the cavity 202 is reduced by operating the vacuum pump 204. Then, the pressure reducing pump 220 is operated to produce a negative pressure in the molten metal passage 210, thus causing the molten metal 206 to be sucked up to the position right below the gate piston 212.

In this state, the piston lower end surface 212*c* should desirably be in fully tight contact with the abutment surface 215, but in view of machining accuracy, it is difficult to bring these surfaces into full surface contact. As a result, with the apparatus shown in FIG. 5, molten metal can enter into a minute clearance formed between the piston lower end surface 212*c* and the abutment surface 215.

When the molten metal enters into the minute clearance between the piston lower end surface 212*c* and the abutment surface 215, it becomes solidified, and the communication between the cavity 202 and the molten metal passage 210 is completely sealed. Thus, the apparatus shown in FIG. 5 can obtain a sufficiently high degree of vacuum in the cavity 202.

DISCLOSURE OF THE INVENTION

In the apparatus shown in FIG. 5, however, there exist the following problems.

Firstly, the metal entered and solidified in the minute clearance between the piston lower end surface 212*c* and the abutment surface 215 is, when the gate piston 212 is opened, sucked into the cavity 202 because this solidified metal is carried along with the molten metal being sucked into the cavity 202. Once the pre-solidified metal is carried into the cavity 202 and surrounding non-solidified molten metal becomes solidified therein, an uneven solidification results to thereby deteriorate the casting quality.

Secondly, when the metal entered into the minute clearance between the piston lower end surface 212*c* and the abutment surface 215 is solidified, it can stick to the piston lower end surface 212*c* or the abutment surface 215. Since this stuck metal in the minute clearance is solid, this stuck metal is scattered in small segments over the surface and thus it is hard to remove. If the next casting cycle is performed under such a state where the removal is not complete, a proper seal cannot be attained and thus, the degree of vacuum in the cavity 202 cannot reach a predetermined degree.

The present invention proposes a casting apparatus where the metal solidified in the clearance between the piston and the abutment surface cannot be carried into the cavity and the solidified metal can be easily removed from the piston or the abutment surface.

To this end, in the present invention, the molten metal is easily led to the sealing portion provided between the piston and the abutment surface. Specifically, a clearance or a groove extending toward the sealing portion is positively provided on either or both of the piston and the abutment surface.

With this arrangement, the molten metal is entered into the sealing portion through the positively provided clearance. The molten metal entered into the sealing portion is solidified therein to block the communication between the cavity and the molten metal passage in a favorable way. At this time, the molten metal entered into the sealing portion is solidified together with the molten metal entered into the clearance extending toward the sealing portion. Therefore, such solidified metal becomes a relatively large one-piece element and thus cannot be carried into the cavity when the gate is opened. Further, this relatively large one-piece element can be easily peeled off if it is stuck to the piston or the abutment surface. Thus, preparatory work required for each work cycle is facilitated.

BEST MODE OF CARRYING OUT THE INVENTION

Figure 1A:
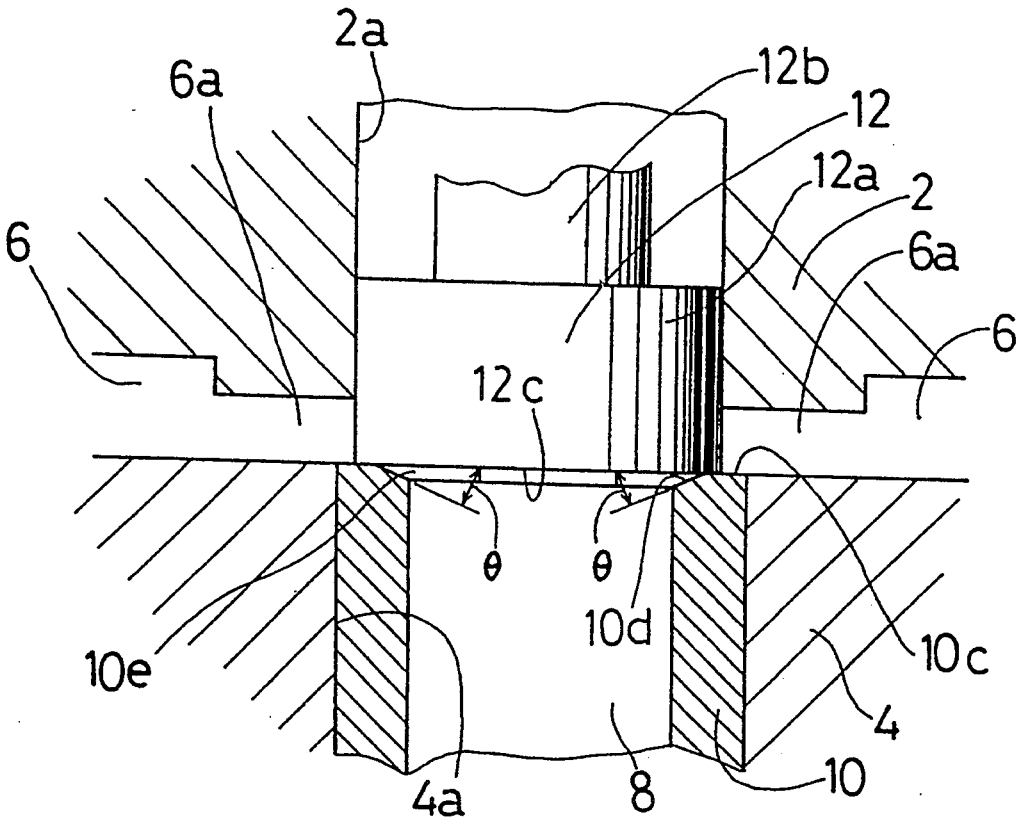
FIG. 1(A) and (B) is a detailed sectional view of a gate mechanism used in the casting apparatus according to a first embodiment of the invention.
Figure 4A:
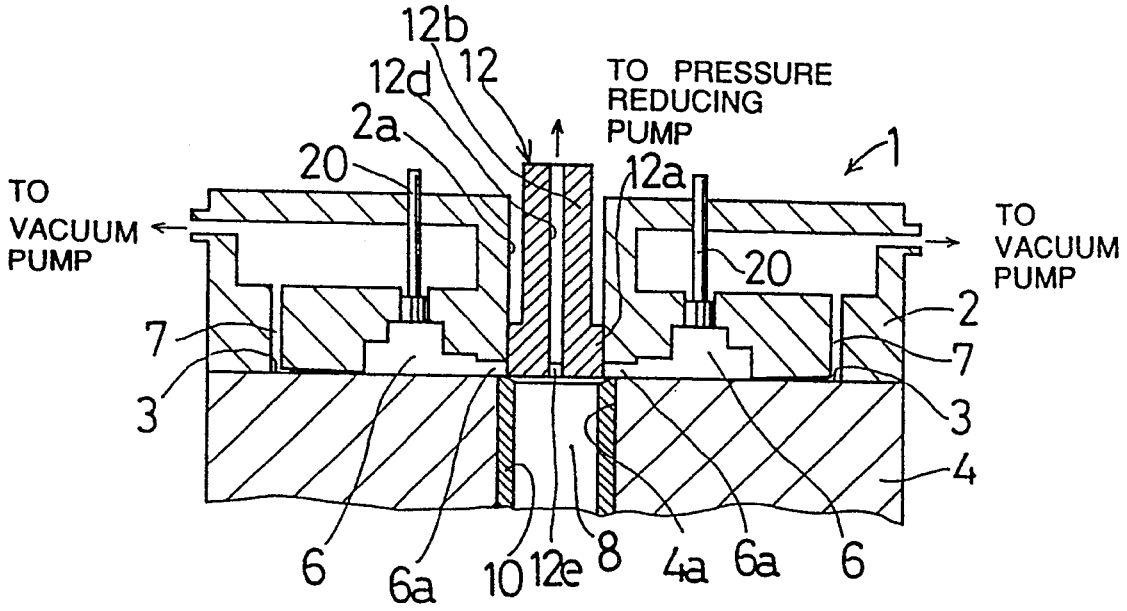
FIG. 4(A) and (B) is a sectional view of the essential parts of a casting die of the casting apparatus of the invention.

Referring now to FIGS. 1 and 4, the vacuum casting apparatus according to a first embodiment of the invention will be described.

FIG. 4 is a sectional view showing the essential parts of a casting die 1 of the vacuum casting apparatus according to this embodiment.

The casting die 1 comprises an upper die 2 and a lower die 4, and in the casting die 1, a cavity 6 is formed when the upper and lower dies 2 and 4 are engaged. The cavity 6 has a central sprue 6*a*, and the sprue 6*a* communicates with a through-hole 4*a* formed vertically in the center of the lower die 4. A cylindrical sleeve 10 is fixed in substantially close contact with the wall of the through hole 4*a*. The interior of the sleeve 10 serves as a molten metal passage 8 for leading molten metal (its temperature being approximately 720° C.) from a reservoir tank (not shown) to the cavity 6.

As shown in FIGS. 1 (A) and (B), the inside wall of an annular upper surface 10*c* of the sleeve 10 has an annular tapered surface 10*d* inclined radially at an angle of $\theta$ ($1.5° < \theta < 15°$) to the upper surface 10*c*. The inclination angle $\theta$ is determined at a range such that molten metal can be easily led into a sealing portion (defined between the sleeve upper surface 10*c* and a piston lower end surface 12*c*) and that the molten metal entered between the tapered surface 10*d* and the piston lower end surface 12*c* can be easily solidified.

As shown in FIG. 4, a through-hole 2*a* is formed in the center of the upper die 2, coaxial with the through-hole 4*a* formed in the lower die 4. A gate piston 12 is slidably accommodated in the through-hole 2*a*. The gate piston 12 has a piston portion 12*a* slidable in the through-hole 2*a* and a shaft portion 12*b* for connecting the piston portion 12*a* to an elevating device (not shown). The piston portion 12*a* is cylindrical in shape as shown in FIG. 1, and has an outer diameter slightly smaller than the outer diameter of the sleeve 10. Thus, when the piston portion 12*a* is in its lower limit position, the lower end surface 12*c* of the piston portion 12*a* is brought into abutting engagement with the upper surface 10 of the sleeve 10, thereby blocking the molten metal passage 8 formed in the sleeve 10. That is, in this embodiment, the upper surface 10*c* of the sleeve 10 serves as an abutment surface. In order to increase the sealing efficiency, the lower end surface 12*c* of the piston portion 12*a* and the upper surface 10*c* of the sleeve 10 are made flat and smooth such that a maximum clearance of 0.2 mm or less is provided between the two surfaces 12*c* and 10*c* which are in abutting engagement. When the clearance is 0.2 mm or less, the molten metal entered into the clearance will be solidified, and the sealing efficiency will not be impaired.

The gate piston 12 and the elevating device therefor and the sleeve 10 serve as a gate mechanism for switching on and off the communication between the molten metal passage 8 and the cavity 6, and the abutting portion between the lower end surface 12*c* of the piston portion 12*a* and the upper surface 10*c* of the sleeve 10 serves as a sealing portion of the gate mechanism. As described above, since the radially inclined annular tapered surface 10*d* is formed in the inside wall of the upper surface 10*c* of the sleeve 10, a groove or a clearance 10*e* of V-shaped configuration in section is formed which extends toward the sealing portion opposite to the cavity 6, with the lower end surface 12*c* of the piston portion 12*a* in abutting engagement with the upper surface 10*c* of the sleeve 10.

As shown in FIG. 4, the gate piston 12 has an axial passage 12*d* formed therein. One end of the passage 12*d* communicates with the molten metal passage 8 via a sintered vent 12*e* disposed on the free end of the gate piston 12. The other end of the passage 12*d* communicates with a pressure reducing pump (not shown). Thus, when the pressure reducing pump is driven, a negative pressure is produced in the molten metal passage 8, causing the molten metal in the reservoir tank to be sucked to this position.

The end of the cavity 6 is communicated with an exhaust passage 7 via an engagement surface 3 of the upper and lower dies 2 and 4. The exhaust passage 7 is connected to a vacuum pump (not shown). Accordingly, when the vacuum pump is driven with the gate mechanism closed, the pressure in the cavity 6 is reduced. That is, the vacuum pump serves as a pressure reducing mechanism for reducing the pressure in the cavity 6.

Designated at 20 is a pressurizing pin 20 which is used to pressurize the molten metal charged into the cavity 6.

The operation of the casting apparatus according to the present embodiment will now be described with reference to FIGS. 1, 3 and 4.

First, the gate piston 12 is moved down to its lower limit position to close the molten metal passage 8, and the vacuum pump is operated to reduce the pressure in the cavity 6. Concurrently with the pressure reducing operation of the cavity 6, the pressure reducing pump is operated to reduce the pressure in the sleeve 10, thus causing the molten metal in the reservoir tank to be sucked into the sleeve 10. Thus, the molten metal passage 8 of the gate mechanism opposite to the cavity 6 is filled with molten metal.

As mentioned above, the sealing portion of the gate mechanism, or the abutting portion between the lower end surface 12*c* of the piston portion 12*a* and the upper surface 10*c* of the sleeve 10, has a minute clearance of 0.2 mm or less. Thus, a sucking force from the cavity 6 acts on the molten metal filled in the molten metal passage 8 via the minute clearance of the sealing portion. The ring-shaped groove 10*e* of V-shaped configuration in section, which is formed at the sealing portion opposite to the cavity 6, enables the molten metal to be effectively led from the passage 8 to the sealing portion and into the minute clearance. The molten metal which enters into the minute clearance of the sealing portion and the molten metal led into the inside of the ring-shaped groove 10*e* lose their heat in these positions and are solidified thereby. Here, the temperature of the casting die 1 is maintained at approximately 180° C.

Thus, the minute clearance is filled with the molten metal led evenly from its periphery into the sealing portion, which improves the sealing performance of the gate mechanism.

Figure 3:
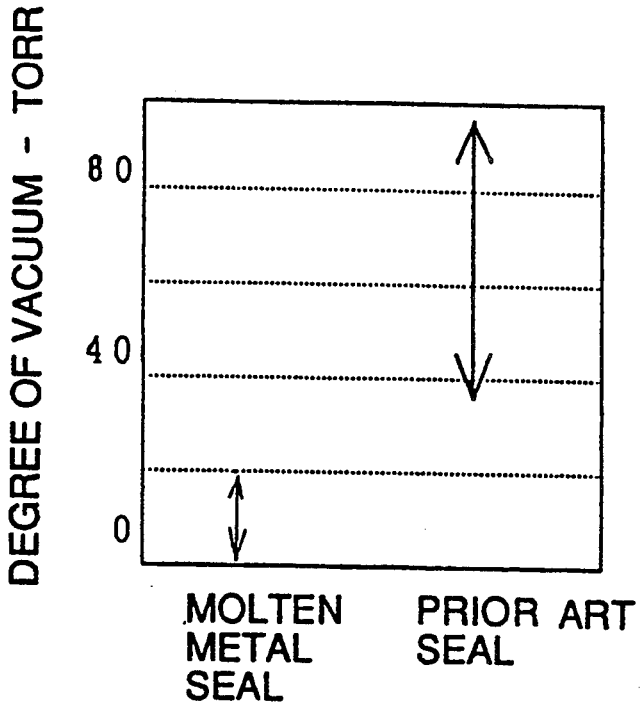
FIG. 3 is a graph comparing the degree of vacuum in a cavity of the casting apparatus according to the invention with that of the prior art casting apparatus.

FIG. 3 shows the degree of vacuum in the cavity 6 when the pressure of the cavity 6 is reduced by the gate mechanism of this embodiment and that by the prior art gate mechanism. With this embodiment, the sealing performance of the gate mechanism is improved, and the degree of vacuum in the cavity 6 is improved as shown in FIG. 3.

Figure 1B:
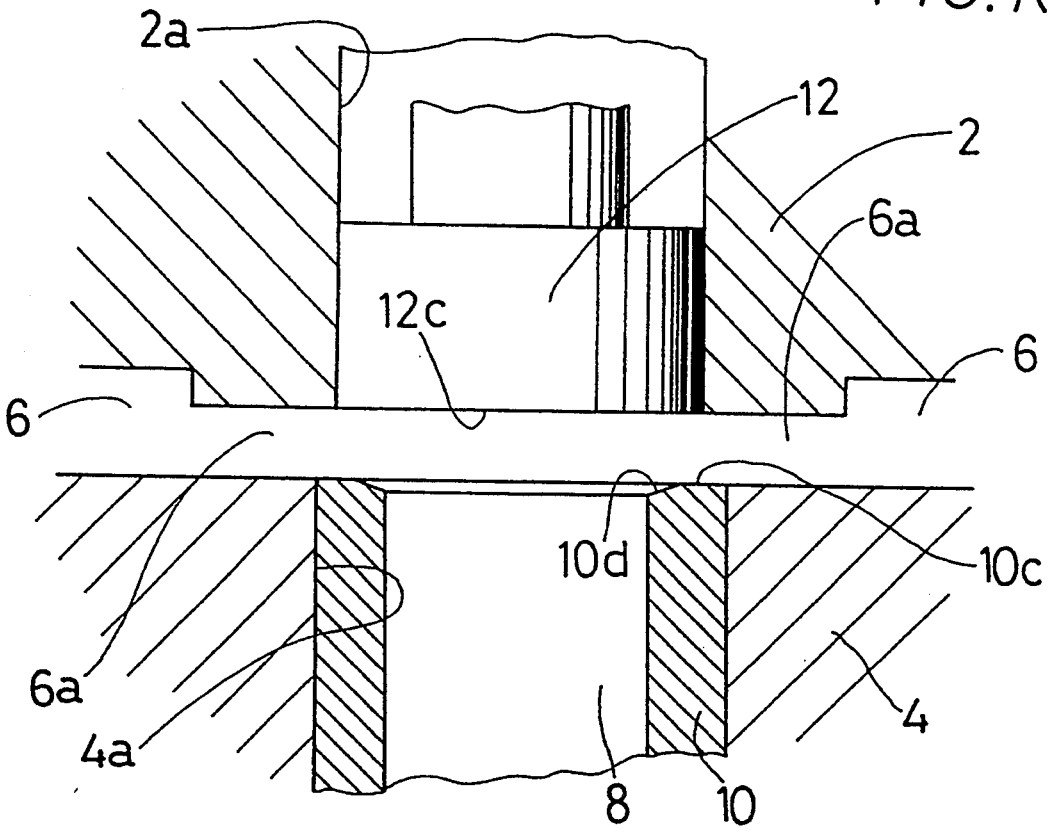
Figure 4B:
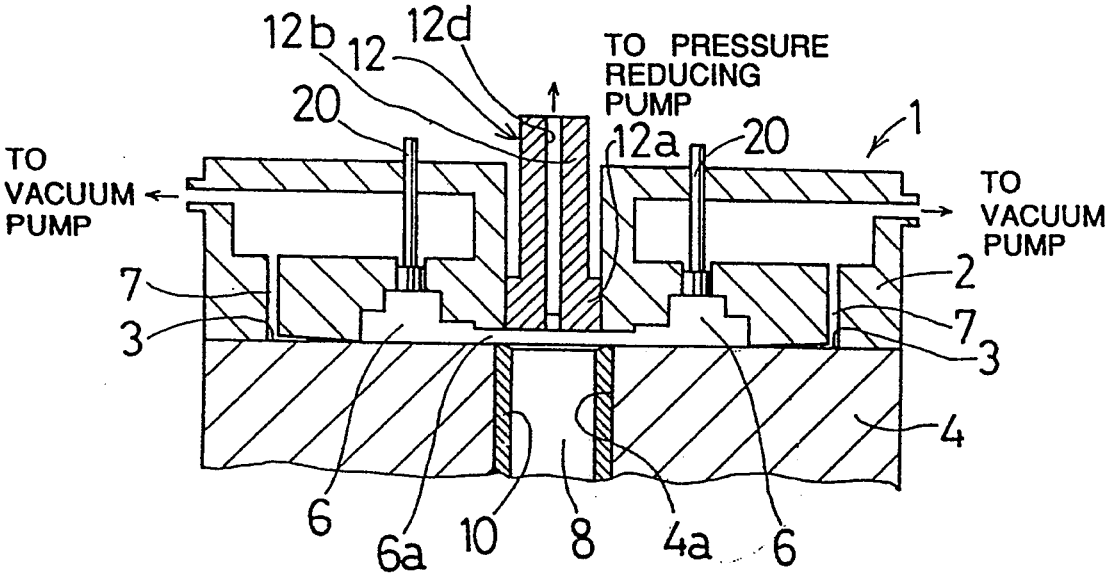
Figure 5:
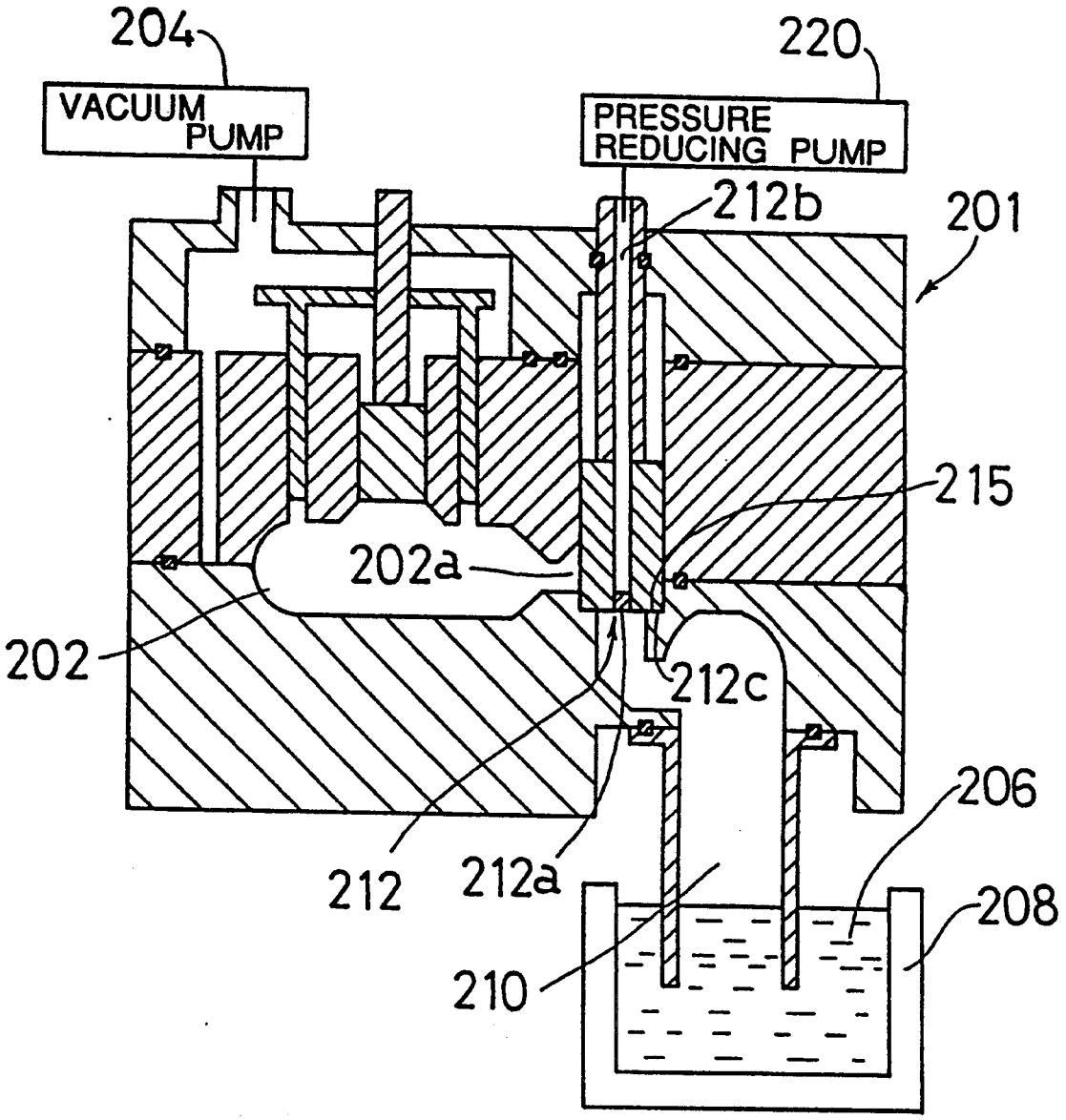
PRIOR ART FIG.5
FIG. 5 is a sectional view of a casting die of the prior art casting apparatus.

When the degree of vacuum in the cavity 6 reaches a predetermined level (approximately 8 torr), the gate piston 12 is raised so that the gate mechanism is opened and the cavity 6 can communicate with the molten metal passage 8 as shown in FIGS. 1(B) and 4(B). As a result, the molten metal which has filled the molten metal passage 8 in the sleeve 10 is sucked and charged into the cavity 6. At this time, the metal solidified in the sealing portion of the gate mechanism and in the ring-shaped groove 10*e* cannot be carried away by the flow of the molten metal being sucked into the cavity 6 and cannot be led into the cavity 6, since the metal piece solidified in the sealing portion is of ring-shaped configuration having a predetermined thickness and weight.

After the cavity 6 is charged with the molten metal, the gate piston 12 is lowered to close the gate mechanism and the cavity 6 is hermetically sealed. In this state, the pressurizing pin 20 is lowered to locally pressurize the molten metal in the cavity 6.

Concurrently therewith, the passage 12*d* formed in the gate piston 12 is opened to atmosphere to release the negative pressure in the sleeve 10, and thus, the molten metal filling in the sleeve 10 is returned to the reservoir tank by its own weight.

When a casting process is thus completed, the casting die 1 is opened to take the casting out of the casting die 1. At this time, the ring-shaped metal piece solidified in the gate mechanism is stuck on the upper surface 10*c* of the sleeve 10, but the metal piece may be easily peeled off since it is a large one-piece element having a predetermined thickness. Thus, metal fragments will hardly remain in the sealing portion.

Figure 2A:
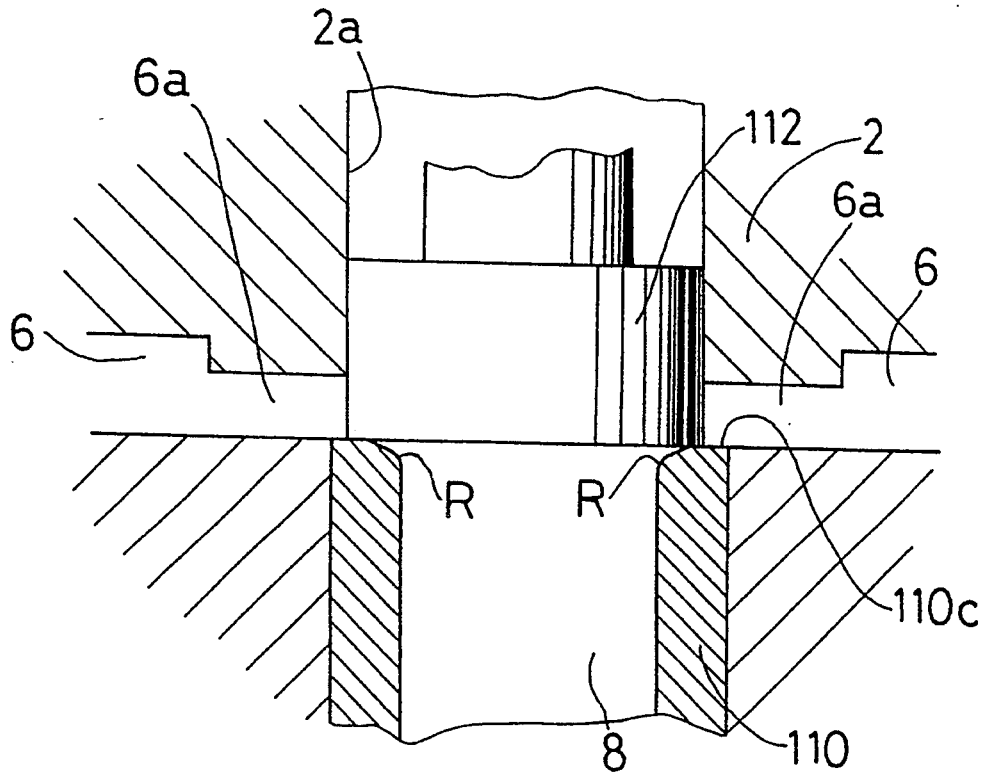
FIG. 2(A) and (B) is a detailed sectional view of a gate mechanism used in the casting apparatus according to a second embodiment of the invention.
Figure 2B:
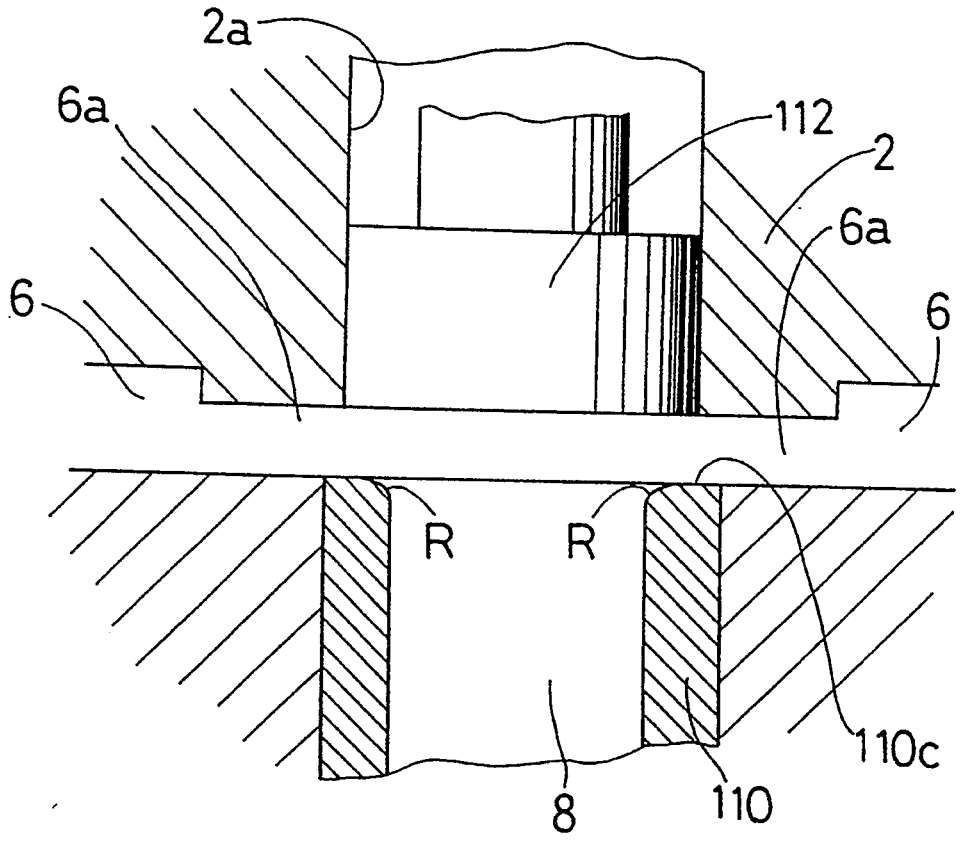

FIG. 2 is a detailed sectional view of a gate mechanism for the casting apparatus according to a second embodiment of the invention.

In this gate mechanism, the inside wall of an upper surface 110*c* of a sleeve 110 is chamfered at a predetermined radius R (R=2 mm to 10 mm). When the gate mechanism is closed, a ring-shaped groove of generally V-shaped configuration in section is formed and extends along and toward the sealing portion. The structure of the gate mechanism according to the second embodiment is thus substantially similar to that of the gate mechanism in the first embodiment, except for a minor difference in the sectional shape of the annular groove.

Therefore, with the casting apparatus of this embodiment, substantially the same effect can be obtained with that of the first embodiment.

While the first and the second embodiments employ a process in which molten metal in the reservoir tank is charged into the sleeve 10 or 110, by sucking the molten metal by the pressure reducing pump, this process is not limitative, and it is possible to pressurize the molten metal in the reservoir tank and charge it into the sleeve 10 or 110. Further, while in the present embodiments, the tapered surface or the chamfered surface is provided on the sleeve side, it is possible to provide such surface on the piston lower end surface, or on both the sleeve upper surface and the piston lower end surface.

According to the invention, the molten metal is solidified not only in the sealing portion but also in the groove formed along the sealing portion, and therefore, the solidified metal piece may be large in size. Therefore, when the casting product is taken out after completion of the casting operation, the metal piece may be easily peeled off, and metal fragments will minimally remain in the sealing portion.

As a result, the sealing portion of the gate mechanism can be kept clean, and the sealing performance of the gate mechanism can be stabilized in the subsequent casting operations as well.

We claim:

1. A vacuum casting apparatus comprising a cavity formed in a casting die, a molten metal passage for communicating with the cavity, a gate for opening and closing the cavity to molten metal in the molten metal passage, and means reducing the pressure in the cavity, where said gate includes a gate piston and an annular surface which said gate piston abuts to form a sealing portion of said gate, and including a clearance space formed in said gate at a location opposite the cavity, said clearance space extending to said sealing portion, wherein said molten metal will fill said clearance space and any minor clearance that exists in the sealing portion between the abutment of said gate piston and the annular surface, and solidify therein.

2. The vacuum casting apparatus as defined in claim 1, wherein said sealing portion is formed at the abutment between said annular surface and a lower end surface of said gate piston, and wherein said clearance space is defined by an annular tapered surface formed at an inner portion of said abutment, said tapered surface being inclined radially inwardly.

3. The vacuum casting apparatus as claimed in claim 2 further comprising a cylindrical sleeve having an upper end surface that serves as said annular surface and an interior that serves as said molten metal passage, said annular tapered surface being formed in an inner portion of said upper end surface so that said clearance space has a v-shaped cross section defined by the upper end surface of said cylindrical sleeve and the lower end surface of said gate piston.

4. The vacuum casting apparatus as defined in claim 1, wherein said sealing portion is formed at the abutment between said annular surface and a lower end surface of said gate piston, and wherein said clearance space is defined by an annular chamfer formed at an inner portion of said abutment.

* * * * *